US011460233B2

(12) United States Patent
Torres et al.

(10) Patent No.: US 11,460,233 B2
(45) Date of Patent: Oct. 4, 2022

(54) REFRIGERATOR COMPRISING AN ICE MAKER ASSEMBLY

(71) Applicant: ELECTROLUX DO BRASIL S.A., Curitiba (BR)

(72) Inventors: Ivo Alberto Pinto Torres, Curitiba (BR); Guilherme Cuman, Curitiba (BR)

(73) Assignee: Electrolux do Brasil S. A., Curitiba (BR)

( * ) Notice: Subject to any disclaimer, the term of this patent is extended or adjusted under 35 U.S.C. 154(b) by 0 days.

(21) Appl. No.: 17/041,574

(22) PCT Filed: Apr. 20, 2018

(86) PCT No.: PCT/BR2018/050119
§ 371 (c)(1),
(2) Date: Sep. 25, 2020

(87) PCT Pub. No.: WO2019/200443
PCT Pub. Date: Oct. 24, 2019

(65) Prior Publication Data

US 2021/0033328 A1 Feb. 4, 2021

(51) Int. Cl.
*F25C 5/20* (2018.01)

(52) U.S. Cl.
CPC ..... *F25C 5/22* (2018.01); *F25C 2400/10* (2013.01); *F25C 2400/12* (2013.01); *F25C 2400/14* (2013.01); *F25C 2500/08* (2013.01)

(58) Field of Classification Search
CPC ..... F25C 1/00; F25C 1/04; F25C 1/10; F25C 1/24; F25C 5/18; F25C 5/185; F25C 5/20;

(Continued)

(56) References Cited

U.S. PATENT DOCUMENTS

2005/0229623 A1* 10/2005 Kim ..... F25D 23/04 62/389
2010/0126210 A1* 5/2010 Rotter ..... F25D 27/00 62/441

(Continued)

FOREIGN PATENT DOCUMENTS

CN 105129878 12/2015
WO 2009062912 5/2019

OTHER PUBLICATIONS

International Search Report for PCT/BR2018/050119, dated Nov. 26, 2018, 2 pages.

*Primary Examiner* — Elizabeth J Martin
(74) *Attorney, Agent, or Firm* — Pearne & Gordon LLP

(57) ABSTRACT

A refrigerator including a cabinet and a compartment formed inside the cabinet and having an open front portion. A compartment door is movably connected to the cabinet for closing at least partially the open front portion of the compartment. An ice maker assembly is arranged inside the compartment and includes an ice maker. The ice maker includes an ice maker casing, a water tank and a water filter. The ice maker assembly is accessible inside the compartment when the compartment door is in an open position. The ice maker assembly includes a support housing arranged below the ice maker casing to receive the water tank and the water filter such that the ice maker casing and the support housing are provided as respective modules.

19 Claims, 18 Drawing Sheets

(58) Field of Classification Search
CPC ..... F25C 5/22; F25C 5/24; F25C 2400/10; F25C 2400/12; F25C 2400/14; F25C 2500/08; F25D 2323/121; F25D 2323/122
See application file for complete search history.

(56) References Cited

U.S. PATENT DOCUMENTS

| | | | | |
|---|---|---|---|---|
| 2012/0111049 | A1* | 5/2012 | Kim | F25D 23/126 62/344 |
| 2012/0297814 | A1* | 11/2012 | Kim | F25D 23/126 62/340 |
| 2015/0241102 | A1* | 8/2015 | Lee | F25C 1/10 62/71 |
| 2016/0370070 | A1* | 12/2016 | Lee | F25C 5/22 |
| 2018/0335246 | A1* | 11/2018 | Jeong | F25D 23/126 |

* cited by examiner

REFRIGERATOR COMPRISING AN ICE MAKER ASSEMBLY

FIELD OF THE INVENTION

The present invention concerns the field of refrigerators. In particular, the present invention refers to a refrigerator comprising an ice maker module.

BACKGROUND ART

Several designs of refrigerators exist which comprise the possibility to produce ice. The ice maker can be arranged in the freezing compartment or the cooling compartment or fresh food compartment which henceforth will be denoted as the compartment.

For the purpose of producing ice, an ice maker assembly is provided which comprises an ice maker, a water tank and a water filter. The water filter is used to filter the water which is fed into the filter from a fresh water supply. The filtered/clean water is then transported into the water tank and can be used in the ice maker for making ice.

Nowadays, refrigerators available on the market with ice makers do not have an optimization in relation with the placement of the water tank, the water filter and the ice maker, which involves long tubes for transporting the water between these components. Usually, water tank, water filter and ice maker in the refrigerator are separated from each other. The water filter is fixed outside the cabinet and the others (tank and ice maker) are fixed inside the product but in different places. Commonly, the replacement of the filter is complex due its position on the backside of the refrigerator and requires moving the refrigerator away from its installation place.

The U.S. Pat. No. 8,640,481 B2 discloses a refrigerator with an ice maker assembly comprising an ice maker, a water filter and a water tank. The water filter, the water tank and a valve provided at a junction of a hose connecting the water filter to the water tank and the ice maker are received in a case as to integrally positioned in the refrigerating compartment.

An object of the invention is to provide a refrigerator which provides an optimized design and handling of the ice maker assembly.

Another object of the invention is to allow convenient replacement of the water filter.

Another object of the invention is to reduce the overall pipe length needed in the realization of the ice maker assembly.

DISCLOSURE OF INVENTION

The invention is based on the consideration that known designs and integrations of ice maker assemblies into a refrigerator have several drawbacks. Maintenance and/or exchange of components such as the water filter can be difficult and tedious. Long pipes are needed for fluid connections between different components. Also, the integration of these components into the compartment can lead to unused spaces in the compartment or a disadvantageous subdivision of the available compartment space. It is therefore desirable to have an ice maker module that reduces or eliminates these disadvantages.

Applicant has found that these demands can be met by building a modular structure of the ice maker casing and a support casing which is designed to encompass the water filter and the water tank. In this way, a new layout is provided which allows positioning parts involved nearest to each other, namely the water tank, the water tank filter and the ice maker, and which also allows easy access for replacing the water filter and to make maintenance of the ice maker and the water tank.

The invention therefore relates to a refrigerator comprising:

a cabinet;

a compartment for storing goods formed inside the cabinet and having an open front portion;

a compartment door movably connected to the cabinet for closing at least partially the open front portion of the compartment;

an ice maker assembly arranged inside the compartment, the ice maker assembly comprising an ice maker to generate ice, the ice maker comprising an ice maker casing, a water tank to store the water to be dispensed to the ice maker and a water filter to filter the water to be dispensed to the water tank, the ice maker assembly being accessible inside the compartment when the compartment door is in open position, whereby the ice maker assembly comprises a support housing arranged below the ice maker casing to receive the water tank and the water filter such that the ice maker casing and the support housing are provided, especially built, as respective modules.

The notion that ice maker casing and support casing are built as modules implies preferably their direct spatial neighborhood and preferably their mechanical connection with each other. The notion of modules or a modular structure therefore preferably implies that ice maker casing and support housing are attached to each other or are integrally built. They can preferably be moved together, for example during the assembly process. The ice maker casing is therefore preferably characterized by at least one fixing portion or fixing element which is configured to establish a mechanical connection to the support housing.

The support housing can be a separate component arranged next to the ice maker casing. The support housing can also be built integrally with the ice maker casing, whereby the ice maker casing comprises a bottom region configured to receive the water tank and the water filter, whereby the bottom region defines the support housing.

The invention therefore also relates to a refrigerator comprising:

a cabinet;

a compartment for storing goods formed inside the cabinet and having an open front portion;

a compartment door movably connected to the cabinet for closing at least partially the open front portion of the compartment;

an ice maker assembly arranged inside the compartment, the ice maker assembly comprising an ice maker to generate ice, the ice maker comprising an ice maker casing, a water tank to store the water to be dispensed to the ice maker and a water filter to filter the water to be dispensed to the water tank, the ice maker assembly being accessible inside the compartment when the compartment door is in open position, wherein the ice maker casing comprises a bottom region to receive the water tank and the filter tank.

The technical features of the dependent claims contain, whereby applicable, also preferred embodiments of the refrigerator specified in this way.

Preferred embodiments of the invention are described in the dependent claims and in the description.

Preferably, the ice maker casing supports the support housing. This especially encompasses a mechanical support and/or a stabilizing effect on the support housing.

Preferably, for supporting the support housing the ice maker casing comprises, especially mechanical, fixing means configured for fixing the support housing to the ice maker casing. In a preferred embodiment, the fixing means comprise at least one anchor nut/shoulder screw inserted in a respective seat arranged at the bottom of the ice maker casing. Preferably, the fixing means comprise at least on screw seat configured to receive a screw lead through a top part of the support housing.

The support housing advantageously comprises engagement elements configured to engage with these fixing means of the ice maker casing. In a preferred embodiment, engagement elements are provided which in a first position allow to arrange the support housing below the ice maker casing without engagement and in a second position allow the fixed positioning of the support housing with respect to the ice maker casing.

Especially preferably, the attachment of the support housing to the ice maker casing is achieved by engagement elements on the support housing engaging with the anchor nuts, while in the front region of the ice maker assembly a screw is used to achieve an optimized alignment between these two components.

The support housing preferably is at least partly fixed to the ice maker casing. In a preferred embodiment, the support housing is fixed to the ice maker casing by at least one anchor nut and or at least one screw.

Advantageously, the support housing is fixed to a bottom side of the ice maker casing. In another preferred embodiment, the support housing is laterally connected to the ice maker casing, which means that connecting elements are provided which are laterally attached/connected to ice maker casing and support housing. In both cases, the ice maker casing and the support housing are connected to each other and can be handled/moved together. Also, in both cases they preferably form a rigid connection.

Preferably, especially in the assembled and/or mounted configuration, a bottom wall of the ice maker casing is in contact with an upper wall of the support housing.

Preferably, the ice maker casing comprises, at least partially, a bottom region defining the support housing. In this way, ice maker casing and support housing are parts of a common casing in which in a top region the ice maker is arranged and in a bottom region the water tank and water filter are arranged. Also, in this integral design ice maker casing and support housing are built in a modular design. Both modules have distinct functionalities. While the ice maker casing contains the ice maker itself, the support housing is built to house both the water filter and the water tank.

Preferably, the support housing comprises a heat-insulating element arranged between the icemaker casing and the water tank and/or arranged between the ice maker casing and the water filter.

The support housing preferably comprises a water tank chamber for receiving the water tank, whereby a water tank cover is provided for covering the water tank chamber.

The water tank cover preferably is built of a heat-insulating material, especially EPS (expanded polystyrene).

Preferably, the support housing comprises an electric heater for preventing water from icing.

Preferably, the electric heater is integrated into the water tank cover or arranged in the water tank cover. The heater preferably is switched on if the ambient temperature of the space in which the refrigerator is installed goes below 18° C.

The support housing advantageously comprises a water filter chamber for receiving the water filter. The water filter preferably is attached to the support housing by a bayonet-type connection. This means that the filter for attachment/detachment has to be rotated by a certain degree.

In a preferred embodiment, a water filter cover is provided for covering the water filter chamber.

Preferably, the filter cover is pivotally mounted to the support housing. Preferably, in order to prevent unintended removal of the water filter cover, the cover is attached to the support housing in such a way that it has to be moved first horizontally and then down to rotate it downwards for getting access to the water filter. The user preferably has to pull the filter cover towards her or him before tilting it downwards.

Preferably the filter cover is attachable to the support housing by a removable elastic connection, especially a snap connection.

In a preferred embodiment, in a mounted position, the water filter chamber is accessible from the bottom side of the support housing and/or from a side opposite to the ice maker casing.

Preferably, a valve housing is arranged in a back side of the cabinet which is designed to receive at least one valve for at least partially directing water from a water supply to the ice maker assembly. Most preferably, the valve housing receives one one-way valve and one two-way valve. Both valves together can also be called a 'valve diverter'.

The valve housing preferably is accessible from a backside of the cabinet and is covered by a valve housing cover.

The tubes/pipes of the water system/water circuit in a preferred embodiment pass inside the cabinet allowing the dispensing of colder water. These tubes are preferably assembled in the back of the refrigerator, between the inner liner and the rear panel.

The advantages of the invention are especially as follows. A modular design of the ice maker casing and a casing/housing designed to house the water filter and the water tank allows to use pipes with small length and a compact arrangement of these components inside the refrigerator compartment. A replacement of the water filter can be achieved in a convenient way by accessing the module, especially if a cover is provided which covers the water filter chamber from below. The arrangement of the double valve in the rear part of the cabinet with an accessibility from the outside allows convenient maintenance of the refrigerator.

BRIEF DESCRIPTION OF THE DRAWINGS

Further characteristics and advantages of the present invention will be highlighted in greater detail in the following detailed description of preferred embodiments of the invention, provided with reference to the enclosed drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

DETAILED DESCRIPTION OF THE INVENTION

Figure 1:
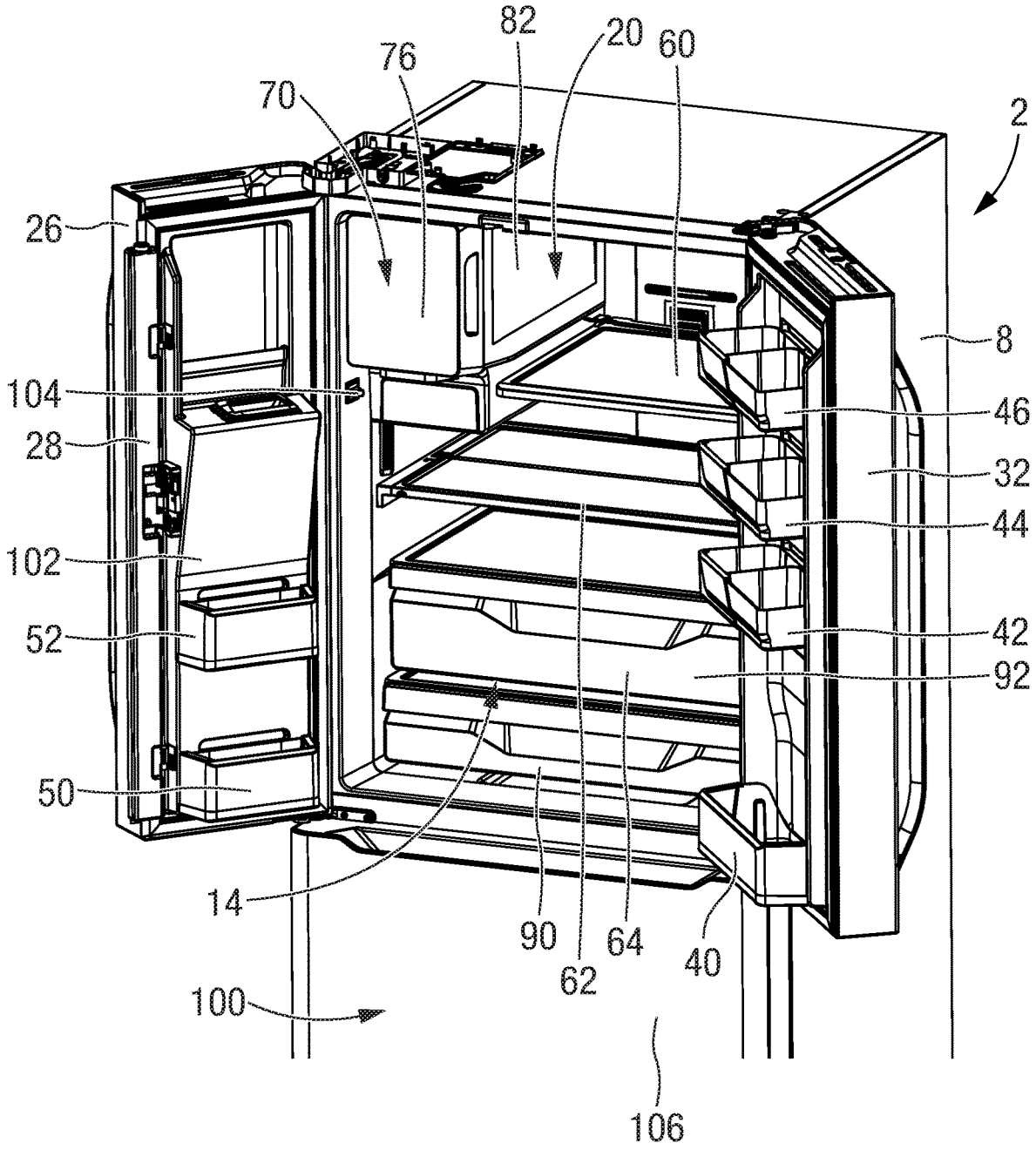
FIG. 1 shows a refrigerator with a compartment and an ice maker assembly arranged therein in a preferred embodiment in a perspective frontal view.

In FIG. 1, a refrigerator 2 is shown with a cabinet 8 in which on the inside a fresh food compartment 14 for storing goods is formed. Compartment 14 has open front portion 20 and two compartment doors 26, 32 attached to opposing sides of cabinet 14 for closing the open front portion of compartment 14. Door 26 is movably attached to a first (in the FIG. left) side of the cabinet 14; door 32 is movably connected to a second (in the FIG. right) side of the cabinet 14. When both doors 26, 32 are closed, the front portion of compartment 14 is fully covered/closed. In right door several containers 40, 42, 44, 46 are arranged for storing goods. In the left door 26, two containers 50, 52 are arranged. Also shown is a flip mullion 28 (moving bar) for closing/sealing the gap between doors 26, 32 when the doors are in a closed position. In compartment 14, several shelves 60, 62, 64 are arranged on which goods/food can be stored. The shelves 60, 62, 64 are preferably positioned on protrusions which are arranged at the inner walls of the cabinet 8 and can be extracted and/or removed for cleaning.

Inside compartment 14, an ice maker assembly 70 is arranged which comprises an ice maker 76 for generating ice. The ice maker 76 comprises an ice maker casing 82, a water tank 86 for storing water to be dispensed to the ice maker and a water filter 90 to filter the water to be dispensed to the water tank 86 (see for example FIG. 8). The ice maker assembly 70 can be accessed inside compartment 14 when door 26 is in an open position.

Inside compartment 14, two drawers 90, 92 are arranged for storing goods/food. In a preferred embodiment the drawer 92 arranged at the lowest level in a mounted position of refrigerator 2 is configured for storing vegetables/fresh food. Refrigerator 8 comprises a freezing compartment 100 which is accessible by a freezing compartment door 106. An ice chute 102 is arranged in left door 26 which receives the ice from an outlet of the ice maker casing 82 when door 26 is closed. An electrical switch 104 is arranged at the inside of compartment 14 for detecting opening/closing of the door.

Figure 2:
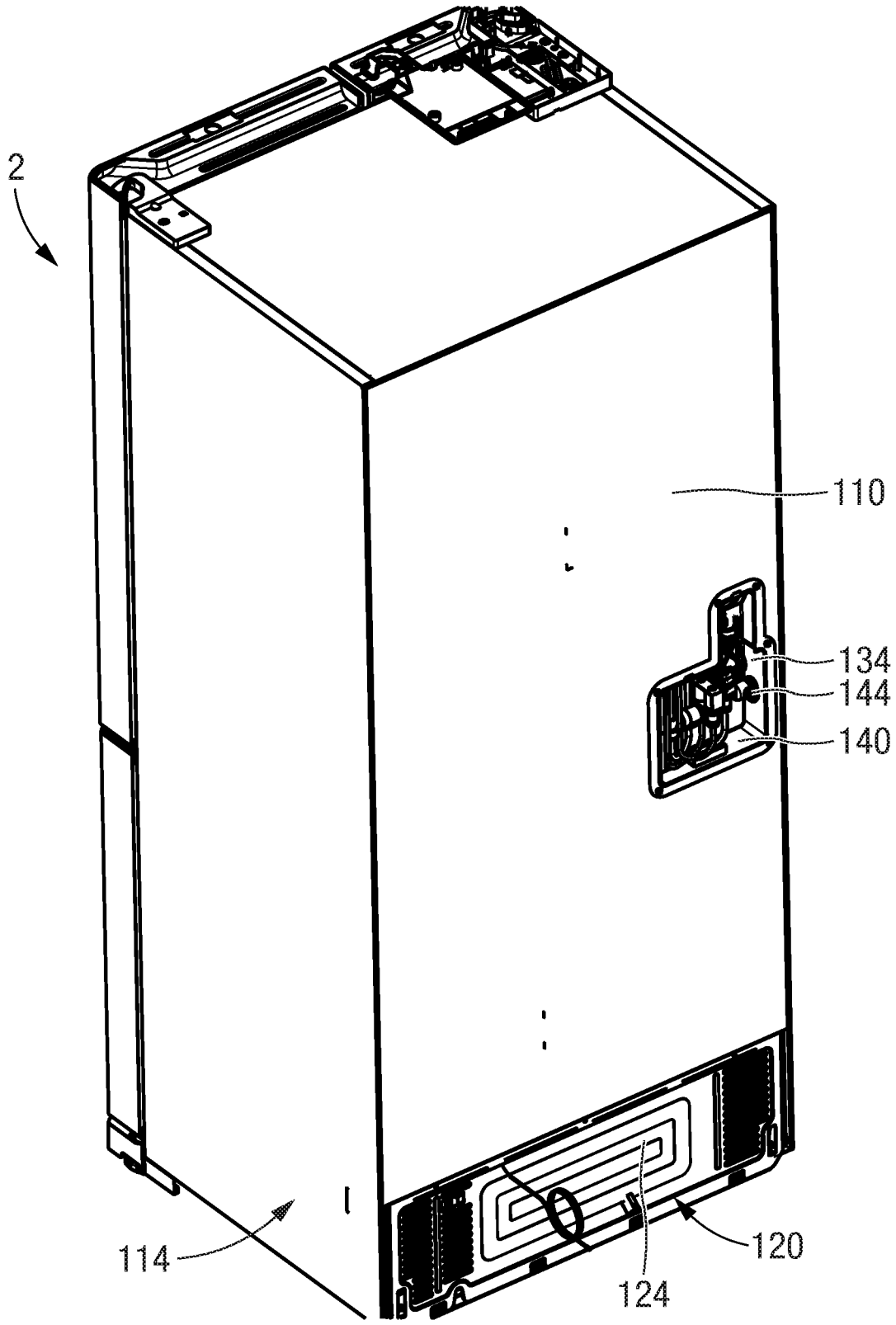
FIG. 2 shows the refrigerator according to FIG. 1 in a perspective back view.
Figure 3:
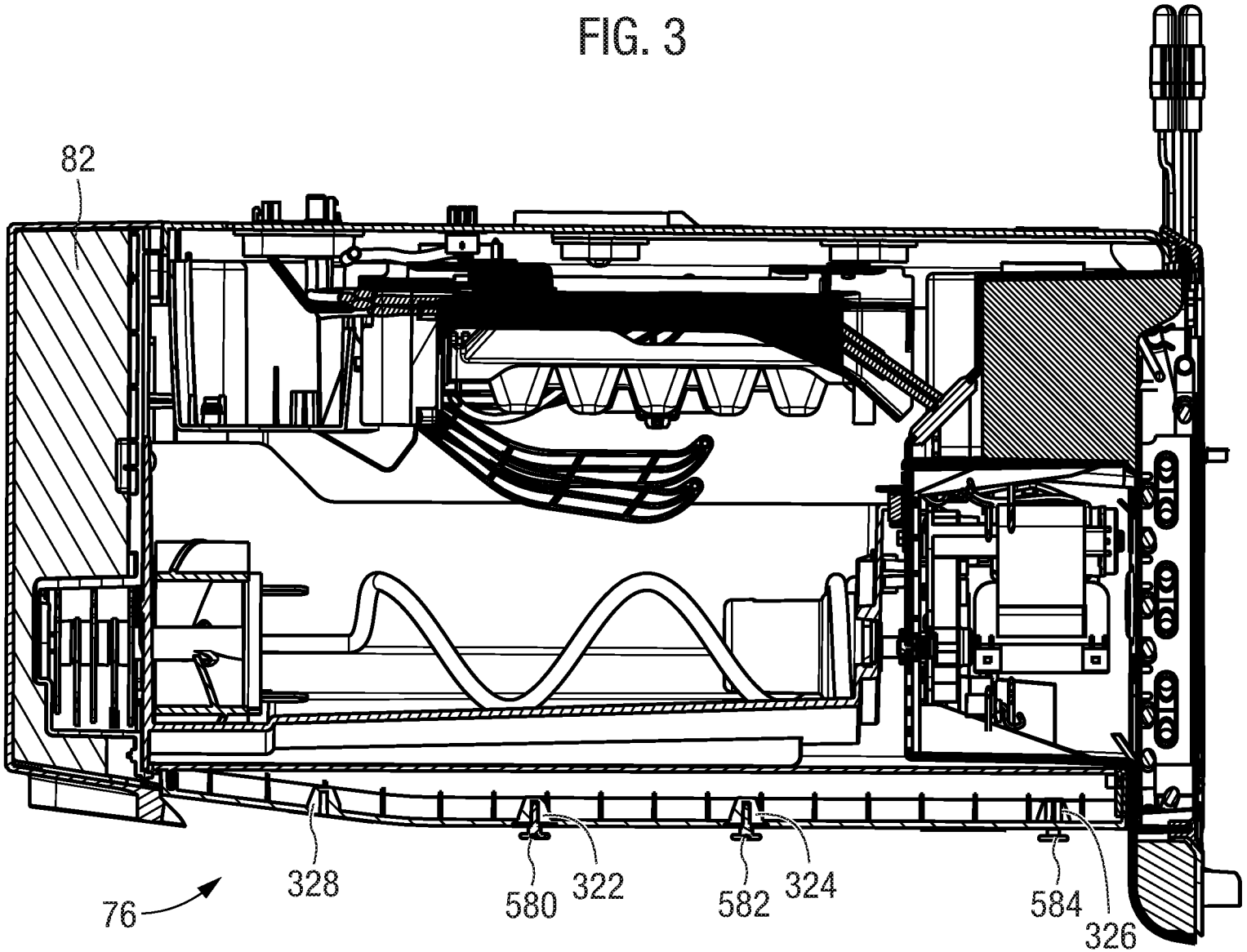
FIG. 3 shows the ice maker casing in a cross section.

FIG. 2 shows refrigerator 2 in a back view. Cabinet 8 comprises a back wall 110. In a lower part 114 of refrigerator 2, a compressor 120 is installed which comprises a heat exchange unit 124. In back wall 110, an opening 134 provides access to a valve chamber 140 in which a double valve 144 is arranged whose function will be explained below. Ice maker casing 82 is arranged in the upper left corner of cabinet 8. It is preferably arranged adjacent to an upper inner wall and a side wall of cabinet 8. In FIG. 3, a cross section through the ice maker assembly is shown.

Figure 4:
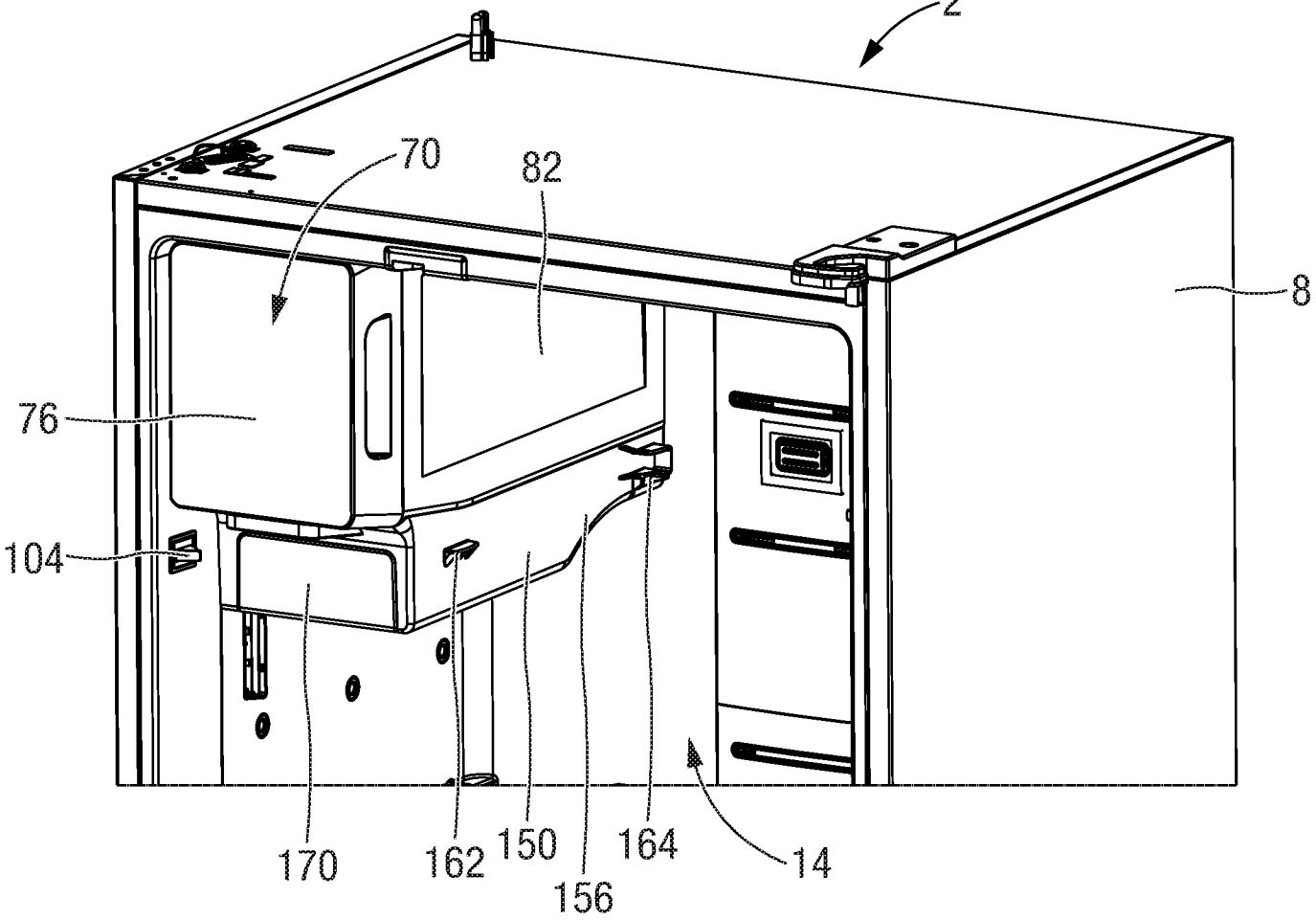
FIG. 4 shows an upper portion of the cabinet of the refrigerator 2 according to FIG. 1.

In FIG. 4, the ice maker assembly 70 is seen in an enlarged view. The ice maker assembly 70 comprises a support housing 150 in which water tank 86 and water filter 90 are spatially arranged. On a side wall 150 which faces an inner region of compartment 14, flanges or protrusions 162, 164 are arranged which are configured to support shelve 60 (see FIG. 1) on one side. Support housing 150 is arranged, in a mounted/operating position of refrigerator 2, below ice maker casing 82 in direct adjacency. The support housing 150 comprises two lateral walls, a front wall and a back wall and a top and a bottom wall. One of the lateral walls in a mounted position is arranged in adjacency, especially in contact with, an inner wall of the cabinet 8. The back wall is adjusted to allow passage of water conduits/pipes from the support housing to at least one valve arranged in a back wall of the cabinet 8. The top side/wall of support hosing 150 faces a bottom wall of ice maker casing 82. A top wall of the ice maker casing 76 is preferably adjacent to/in direct contact with a top inner wall of cabinet 8.

Figure 5:
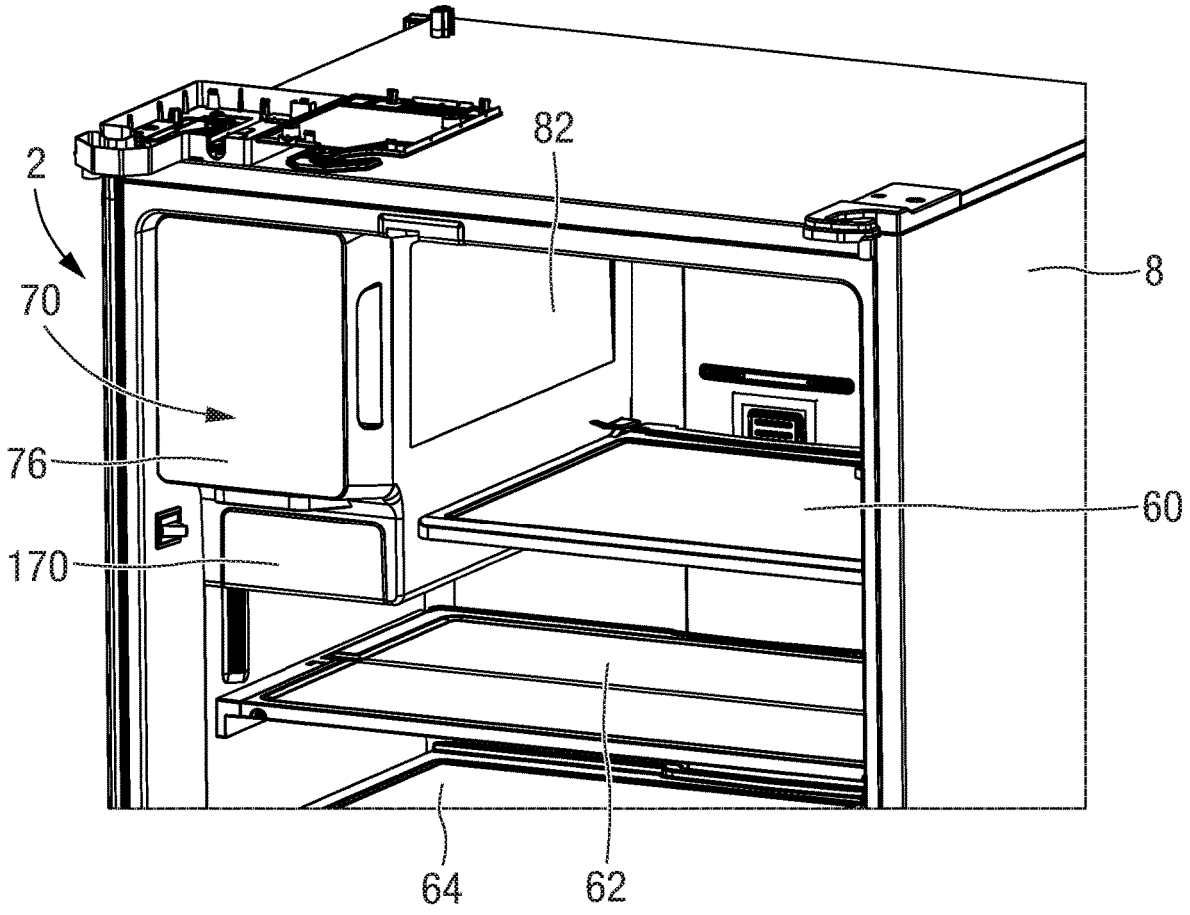
FIG. 5 shows the upper portion of the cabinet according to FIG. 4 with three shelves inserted into the compartment.

The support housing 150 comprises a cover 170 which can be removed for accessing water filter 90. Ice maker casing 82 and support housing 150 are built as respective modules arranged next to each other. In FIG. 5, the region of the refrigerator 2 according to FIG. 4 is shown with shelves 60, 62, 64 inserted into compartment 14. As can be inferred from this FIG., shelve 60 is supported laterally by protrusions 162, 164. Further protrusions are arranged on the inner wall of cabinet 8 opposed to ice maker assembly 70.

Figure 6:
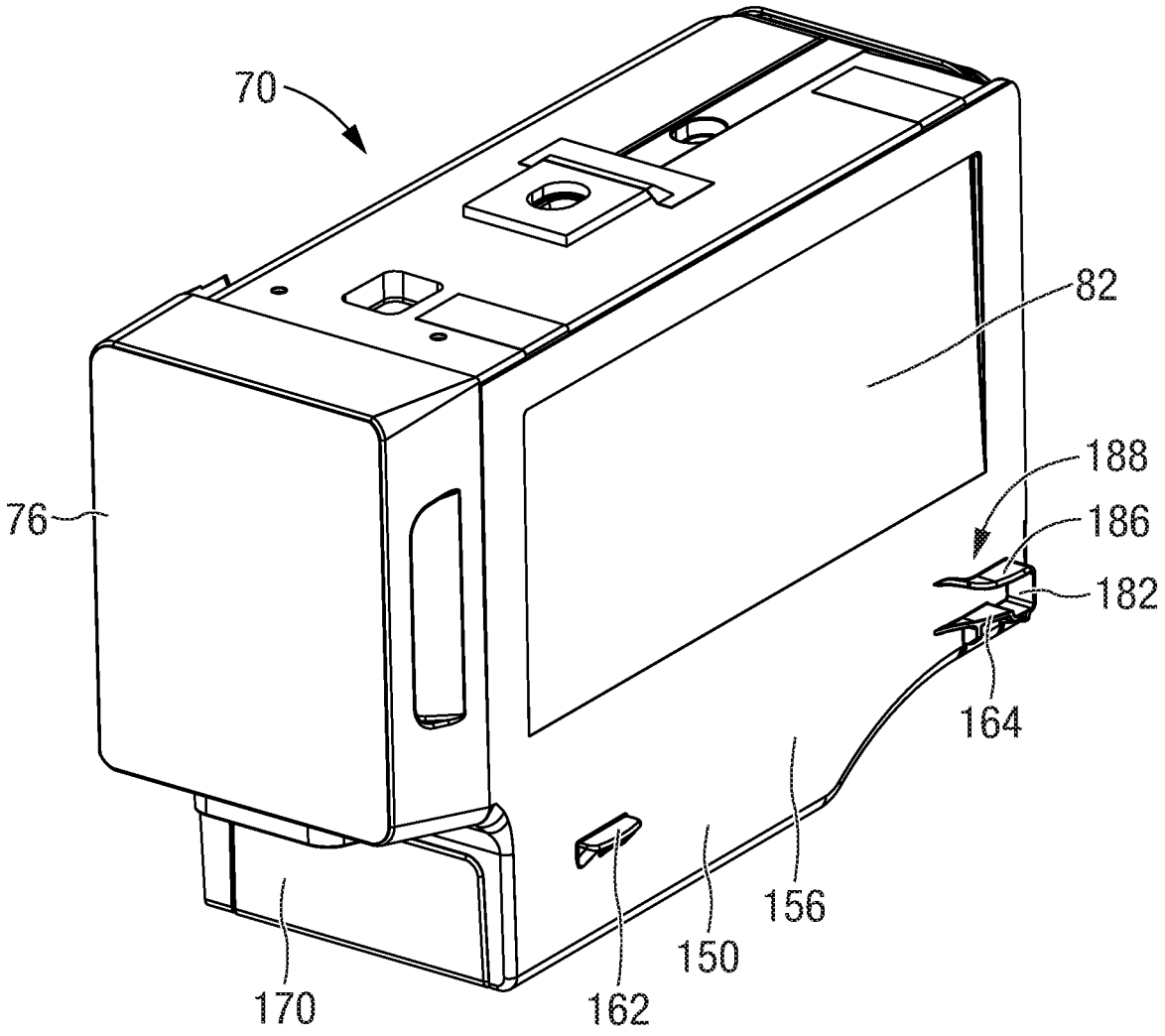
FIG. 6 shows a perspective view of the ice maker assembly with a support housing.

The ice maker assembly 70 is shown in a perspective view in FIG. 6. The protrusion 164 is a part of a holding element 188 which further comprises a stopping element 182 and a clamping element 186. When shelve 60 is inserted into compartment 14, stopping element 182 provides a resistance and a stop for a further movement of shelve 60 into the compartment 14. The clamping element 186 in the inserted state of shelve 60 exerts pressure on shelve 60 and yields a firm placement of shelve 60.

Figure 7:
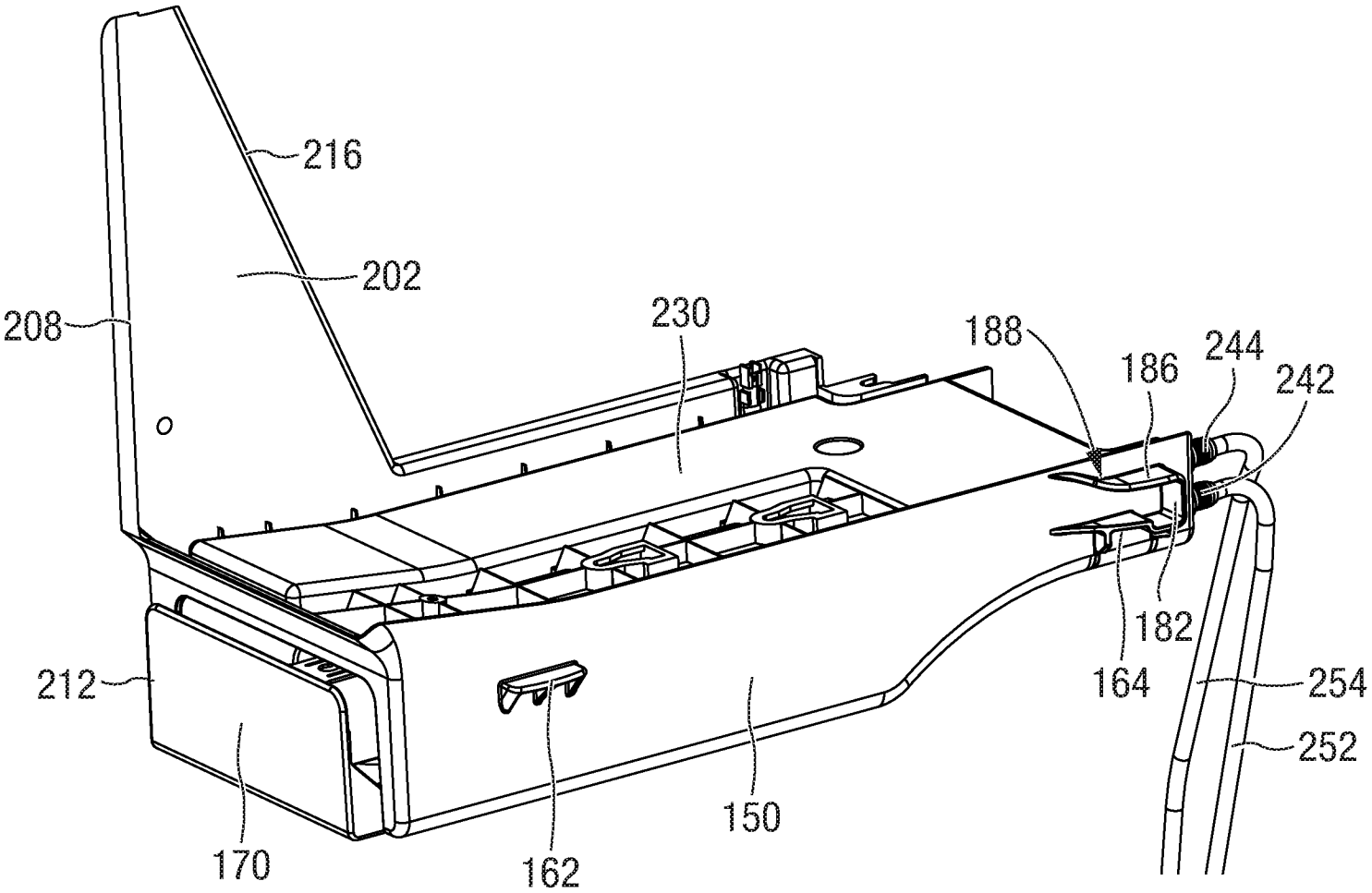
FIG. 7 shows a perspective view of the support housing of the ice maker assembly.

As can be seen in FIG. 7, the support housing 150 on a lateral side comprises a wing 202 which essentially is built in the shape of a shark flapper. A first edge 208 of wing 202 is parallel aligned with an edge of the cover 170, while another edge 216 which is closer to a rear portion of cabinet 8 is inclined with respect to edge 208, yielding the wing-type or shark flapper shape. The wing 202 is arranged, in the mounted position, between ice maker casing 82 and a wall of cabinet 8, thereby closing the gap between ice maker casing 82 and cabinet 8, leading to a more pleasing aesthetic design.

Also seen in FIG. 7 is a water tank cover 230 which covers the water tank 86 arranged within support housing 150. The tank cover 230 is preferably made of a heat-insulating material for insulating the water tank with respect to the ice maker casing 82. This insulation is especially preferably due to the spatial vicinity of water tank 86 and the ice maker casing 82. Preferably an electrical heater 352 is integrated into tank cover 230 or is arranged within tank cover 230, avoiding freezing of the water in water tank 86. A water inlet 242 and a water outlet 244 are connected by respective pipes 252, 254 to a valve diverter 144. Water from the valve diverter 144 is lead through pipe 252 and inlet 242 into the water filter 90 from where it is directed into water tank 86. Via outlet 244 and pipe 254, water is lead into a two-way-valve of valve diverter 144 (see below) for selectively channeling the filtered water to the ice maker 76 or a water dispenser.

Figure 8:
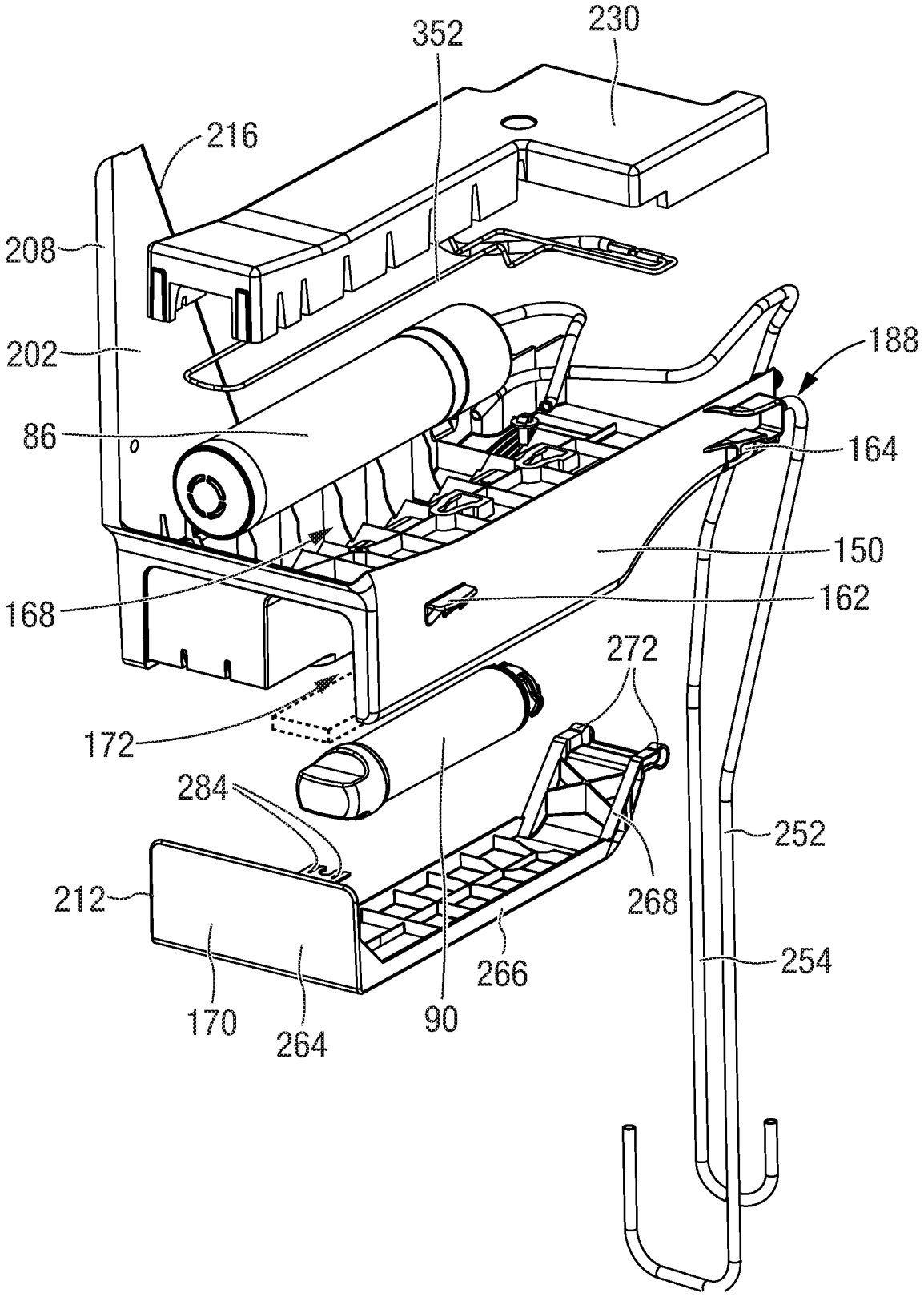
FIG. 8 shows an explosive view of the support housing and other components.

FIG. 8 shows an explosive view of support housing 150 and other parts arranged therein or connected. Cover 170 has a front plate 264, a bottom part 266 and a rear part 268. Rear part 268 comprises two suspension elements 272 which engage with elements of the support housing 150. Front plate 264 comprises two engagement elements 284 which in the closed position of cover 170 engage with support housing 150. Support housing 150 comprises a water tank chamber 168 which receives the water tank 86. Support housing 150 further comprises a water filter chamber 172 which receives the water filter 90.

Figure 9:
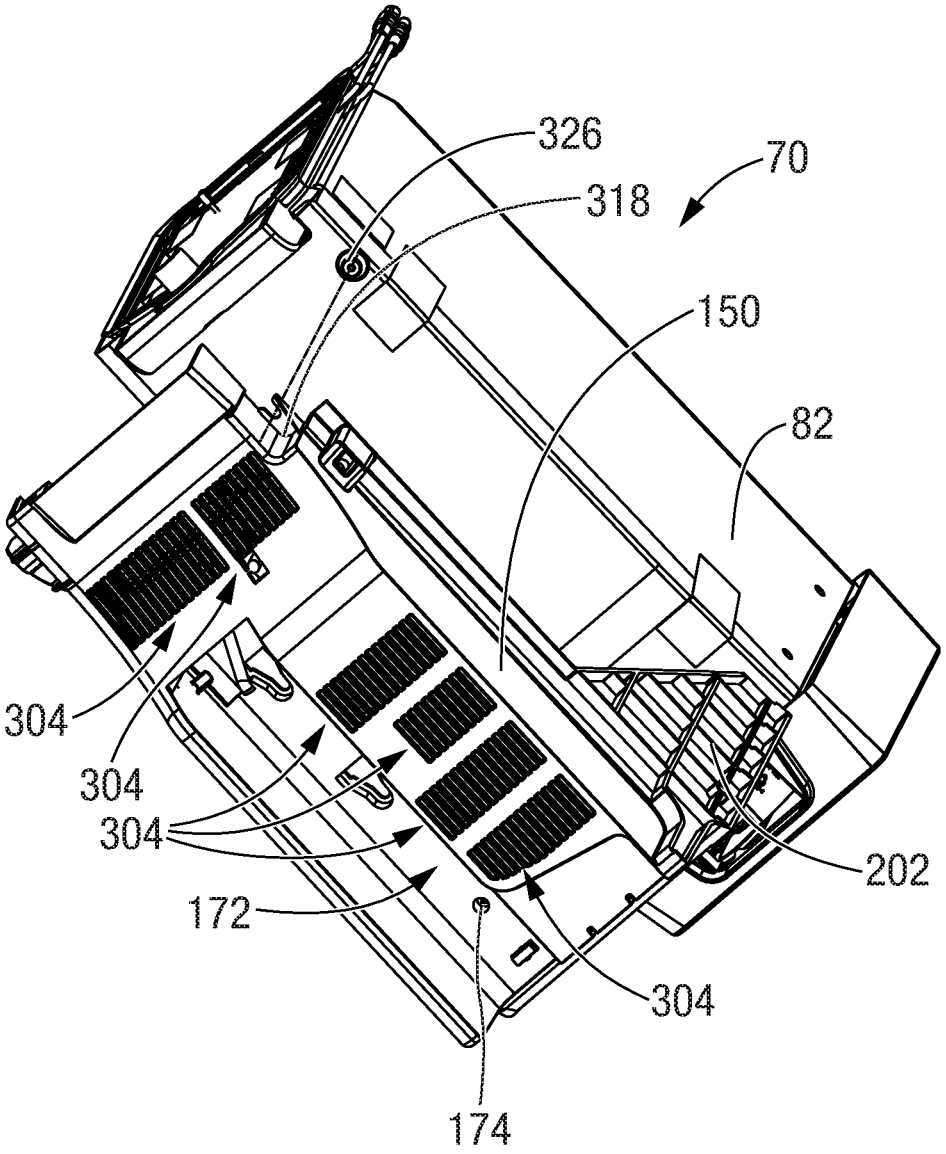
FIG. 9 shows a perspective view of support housing and ice maker casing.
Figure 10:
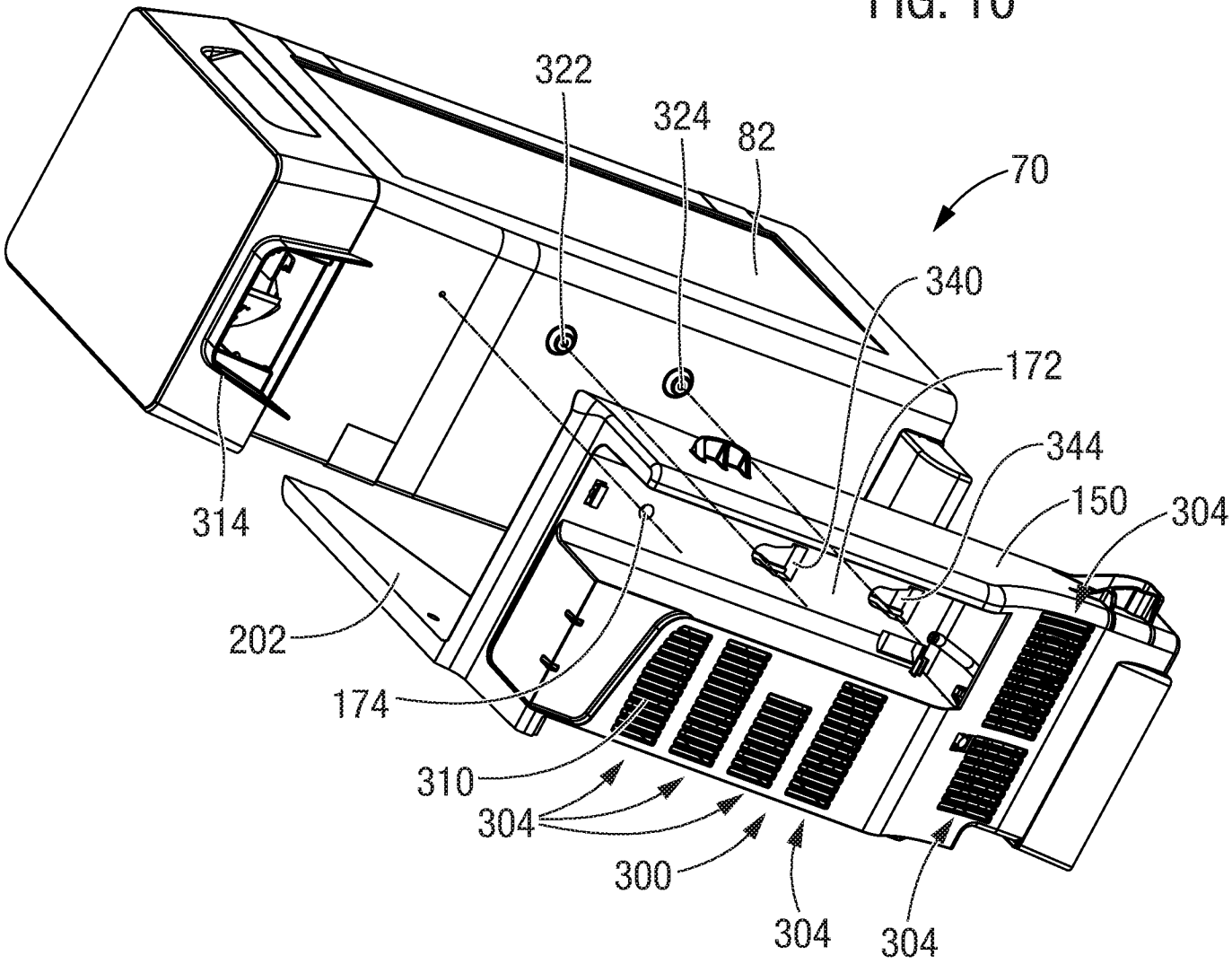
FIG. 10 shows another perspective view of support housing and ice maker casing.

FIGS. 9 and 10 show two different perspective views of support housing 150 and ice maker casing 82 looking at a bottom side of support housing 150. On bottom side 300, preferably at least one group 304 of slots 310 is provided for allowing heat exchange between the internal space of support housing and the external environment, especially for allowing heat exchange with the fresh food compartment in which the ice maker assembly 70 is arranged. Preferably, these slots 310 are arranged below the water tank chamber 168. Also visible in these FIGs as well as in FIG. 3 are three seats 322, 324, 326 which receive anchor nuts 580, 582, 584 or shoulder screws which are preferably inserted, especially pressed, into seats 322, 324, 326 during the manufacturing process of the ice maker assembly 70. Particularly the seats 322, 324, 326 are provided during the injection molding process to form the bottom wall of the ice maker casing 82 and the anchor nuts 580, 582, 584 are screwed or directly embedded into the seats 322, 324, 326.

As can be seen in FIG. 3, the respective shoulder screw 580, 582, 584 comprises a neck region between a shoulder region and a head region.

In other preferred embodiments, alternatively or in combination to a connection of a top side of the support housing 150 to a bottom side of ice maker casing 82. The support housing 150 can be laterally connected to the cabinet 8. It is also possible to have more or less screws or elastic connection means. For instance, a click or snap connection can be provided by which during the assembly process allows a spatial fixation of support housing 150 with respect to ice maker casing 82. Then a screw connection can provide the desired stability of the connection of the support housing 150 to the ice maker casing 82. Reference numeral 314 denotes an outlet for ice that is dispensed to the ice chute 102. Also shown are three engagement elements 340, 344, 318 which engage with anchor nuts 580, 582, 584

Figure 11:
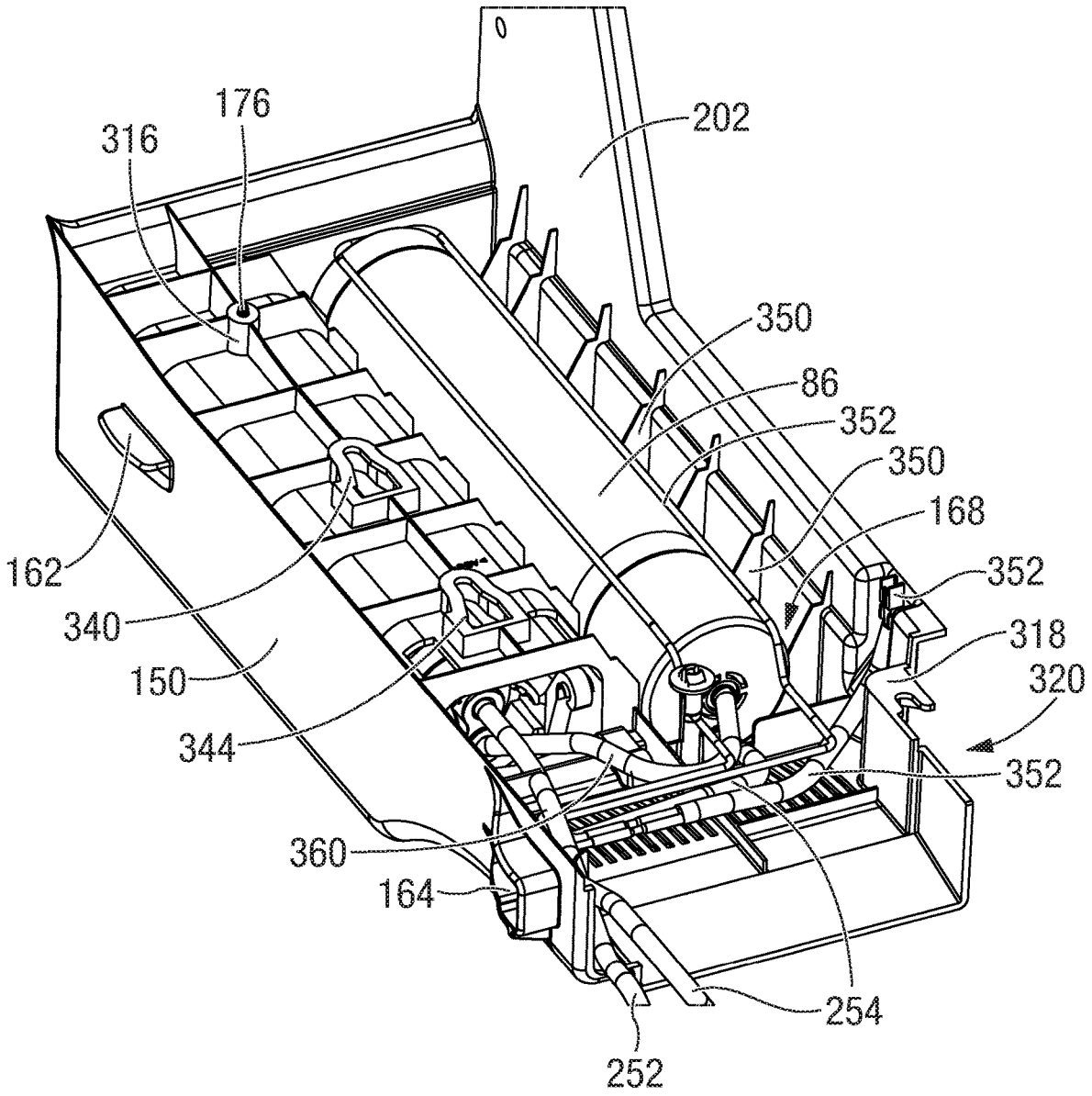
FIG. 11 shows the support housing with the water tank inserted in a water tank chamber.

In FIG. 11, support housing 150 is shown with the water tank 86 inserted in water tank chamber 168. Water tank 86 is resting against several ribs 350. A pipe 360 connects the water filter 90 with the water tank 86 for allowing water which has been filtered by water filter 90 to enter water tank 86. Pipe 252 is configured to allow water to enter water filter 90 for filtering. For the connection of the support housing 150 to the ice maker casing 82, also a front screw 176 (see FIG. 12) is used which is inserted into a screw seat 328 in ice maker casing 82 (see FIG. 13). The front screw 176 is lead through an opening 174 in support housing 150 (see FIGS. 9 and 10) and a screw housing 316. While the essential mechanical connection of support housing 150 to ice maker casing 82 is achieved via engagement elements 340, 344,318, the frontal screw connection allows accurately fixing the bottom parts of ice maker casing 82 to support housing 150 and to provide an aesthetically pleasing visual impression without any visible gaps.

On a rear region 320 of support housing 150, an engagement element 318 is arranged to engage between the head and the shoulder parts of the shoulder screw 584/anchor nut which is inserted in a seat 326 of ice maker casing 82.

An electric heater 352 which at least partially is arranged on the water tank 86 is provided for heating the water in the water tank if needed. The electric heater 352 preferably comprises a wire which is directly arranged on the water tank 86 and which heats up when set under voltage. As can be seen in this FIGS. 8 and 11, engagement elements 340, 344, 318 have a cross section with a narrow end and with a broader end. During assembly, when the support housing 150 is connected to the ice maker housing or casing 82, the anchor nuts 580, 582, 584 can be inserted into the broader region of engagement elements 340, 344. Then the support housing 150 can be moved to engage the engagement elements 340, 344, 318 at their respective narrow end with anchor nuts 580, 582, 584 in such a way that they encompass a neck region of the respective anchor nut 580, 582, 584. In this way, the support housing 150 is fixed to ice maker casing 82 in a locking/engagement configuration of engagement elements 340, 344, 318 and anchor nuts 580, 582, 584.

Figure 12:
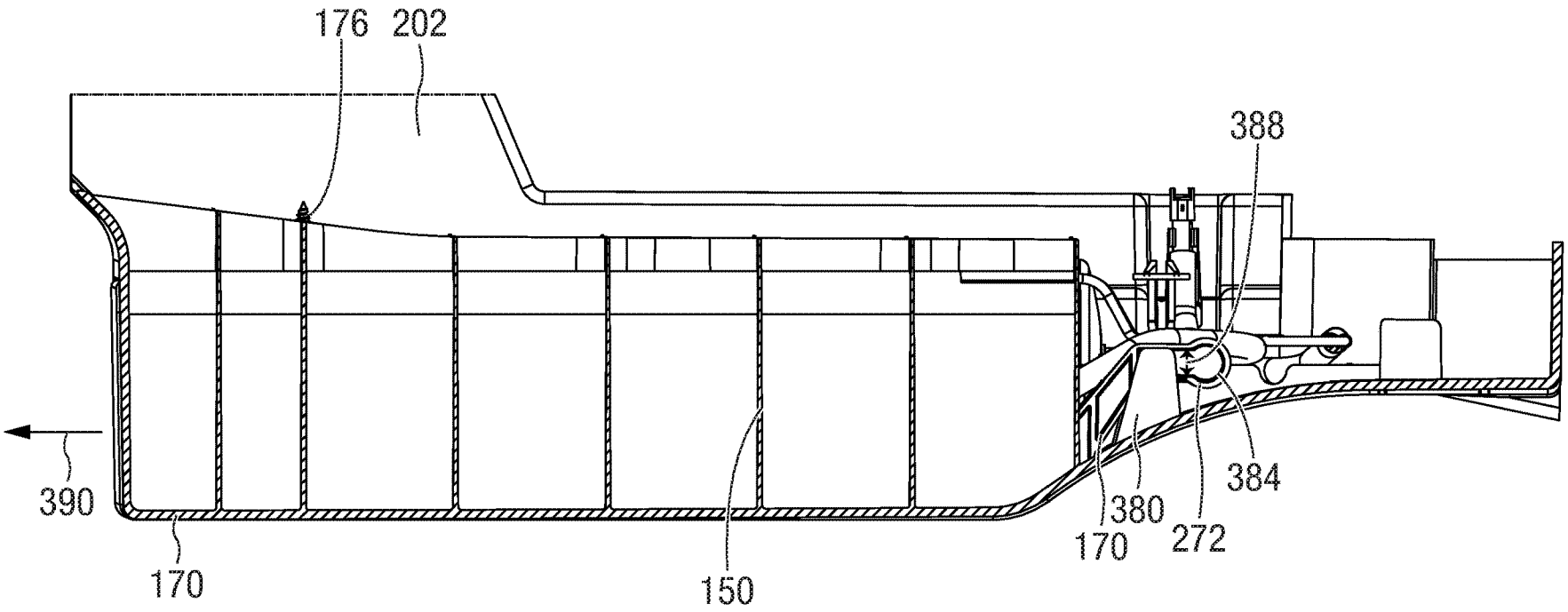
FIG. 12 shows a cross section through the support housing.
Figure 13:
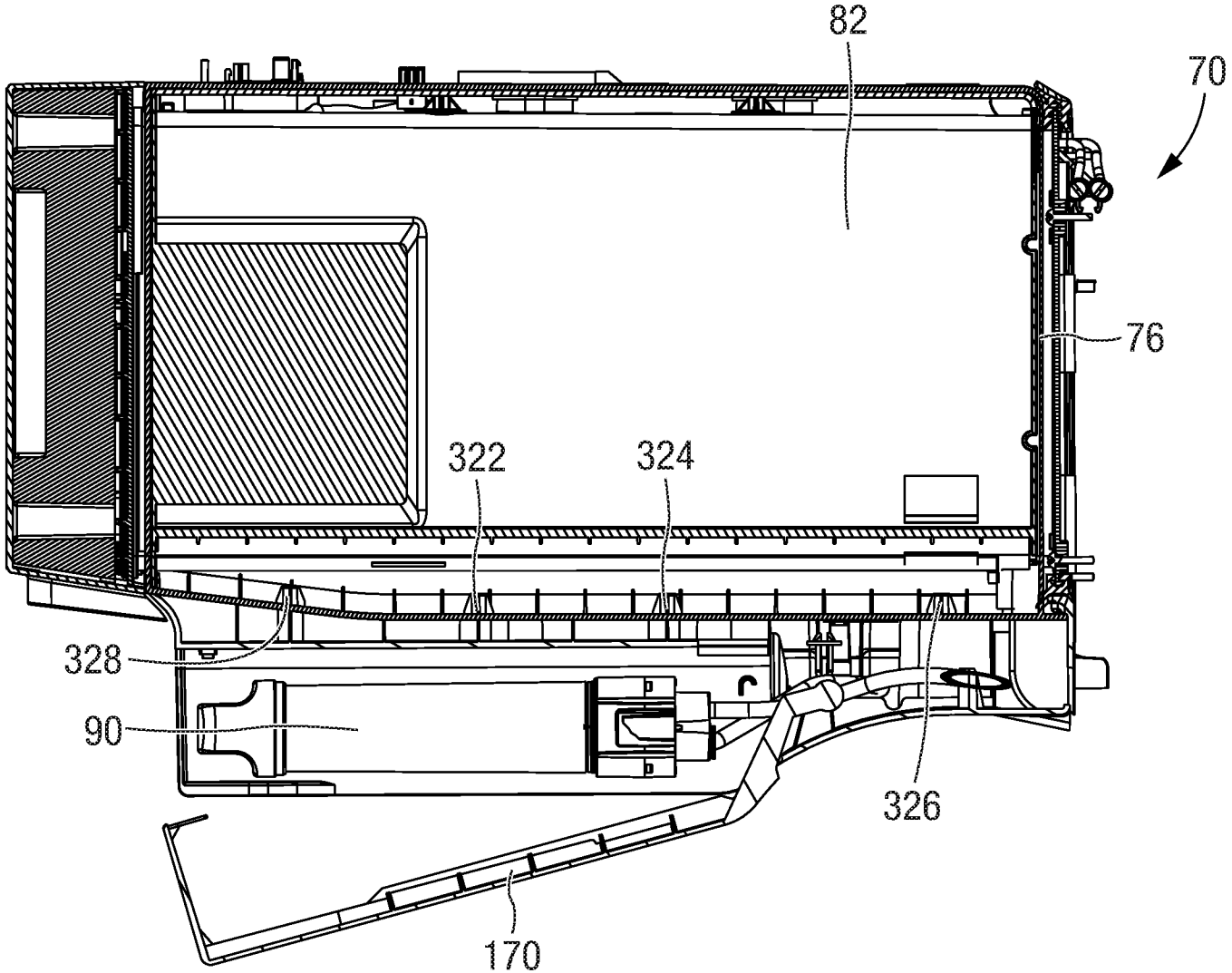
FIG. 13 shows a cross section through the ice maker assembly.

In FIG. 12, a cross section through support housing 150 is shown. The water filter cover 170 is shown in a closed position. A holding element 380 is inserted into suspension element 272 which at one end is shaped with a semicircle with an inner diameter being larger than a distance 388 of two parallel sides of suspension element 272. In the closed position, the holding element 380 is arranged in the part of suspension element 272 with its parallel sides. In order to access the water filter 90, the user has to pull the cover 170 in a pulling direction 390 until the holding element 380 is arranged within the inner diameter of suspension element 272. The cover 170 can then be tilted around an axis going through this inner diameter until a position is reached which is shown in FIGS. 13, 14 and 15.

Figure 14:
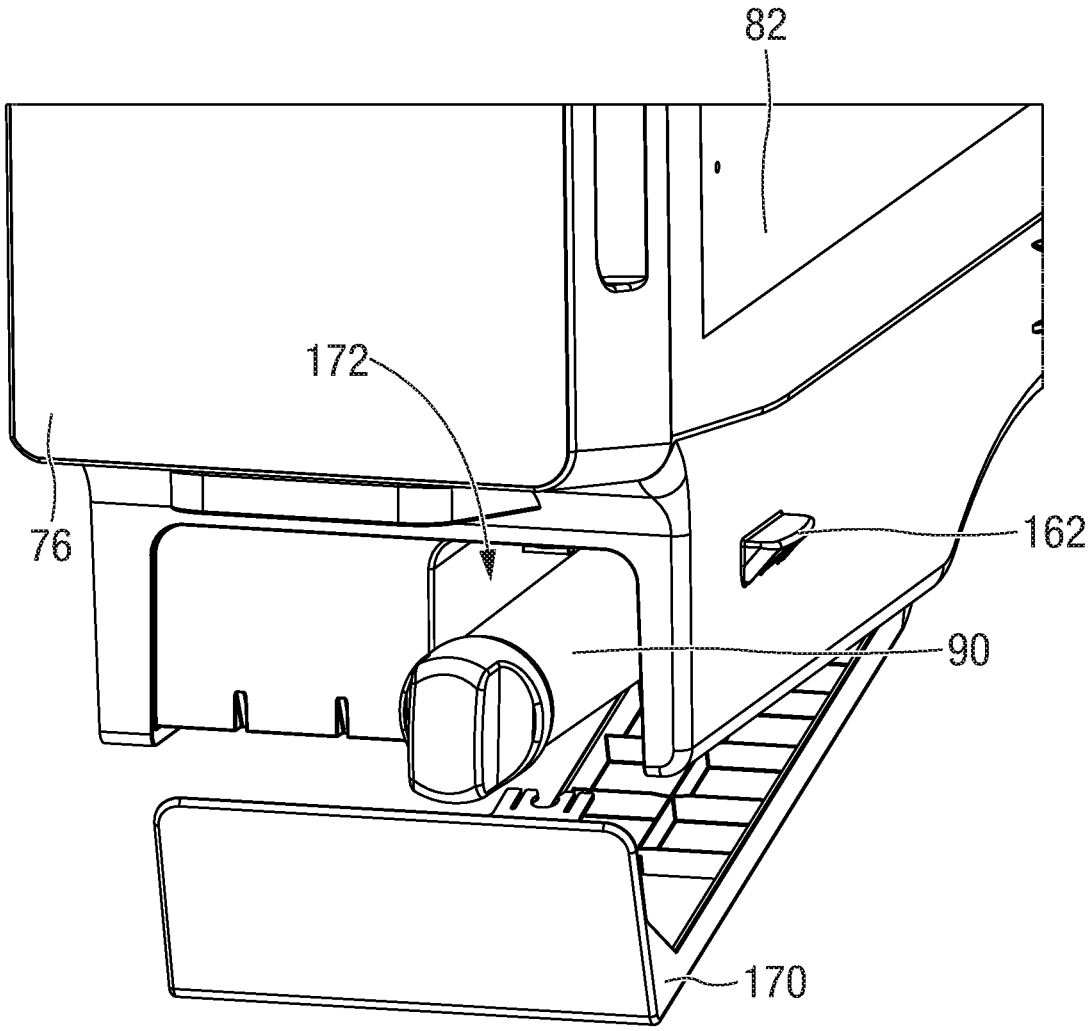
FIG. 14 shows a perspective view of the support housing with the water filter cover partly released and the water filter in a first configuration.
Figure 15:
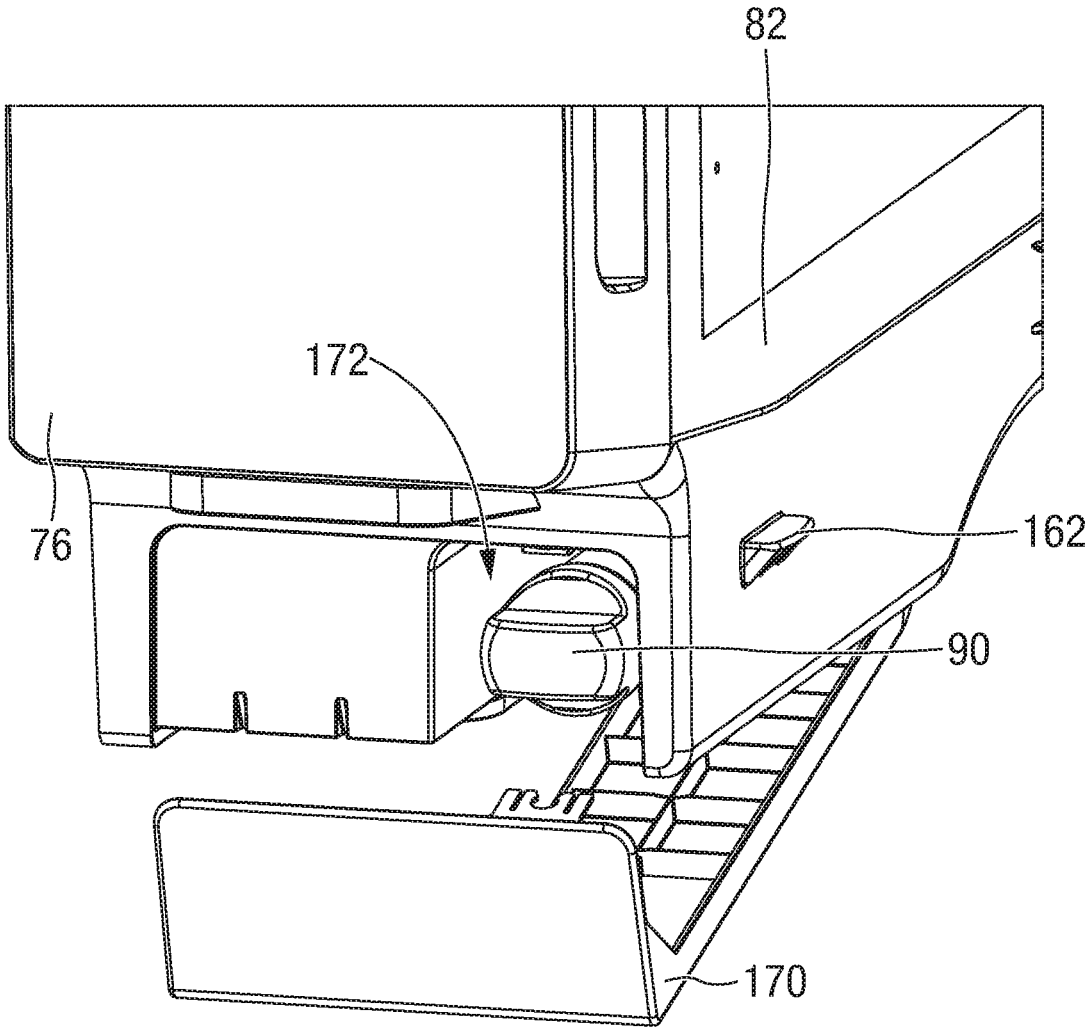
FIG. 15 shows a perspective view of the support housing with the water filter cover partly released and the water filter in a second configuration.

In FIG. 14, water filter 90 is shown in a first configuration in which it is not extractable from water filter chamber 172. Water filter 90 can be extracted after rotating it by 90° in the clockwise or counter-clockwise direction and then by pulling it. Preferably, it is connected to the support housing 150 by a bayonet-type connection.

Figure 16:
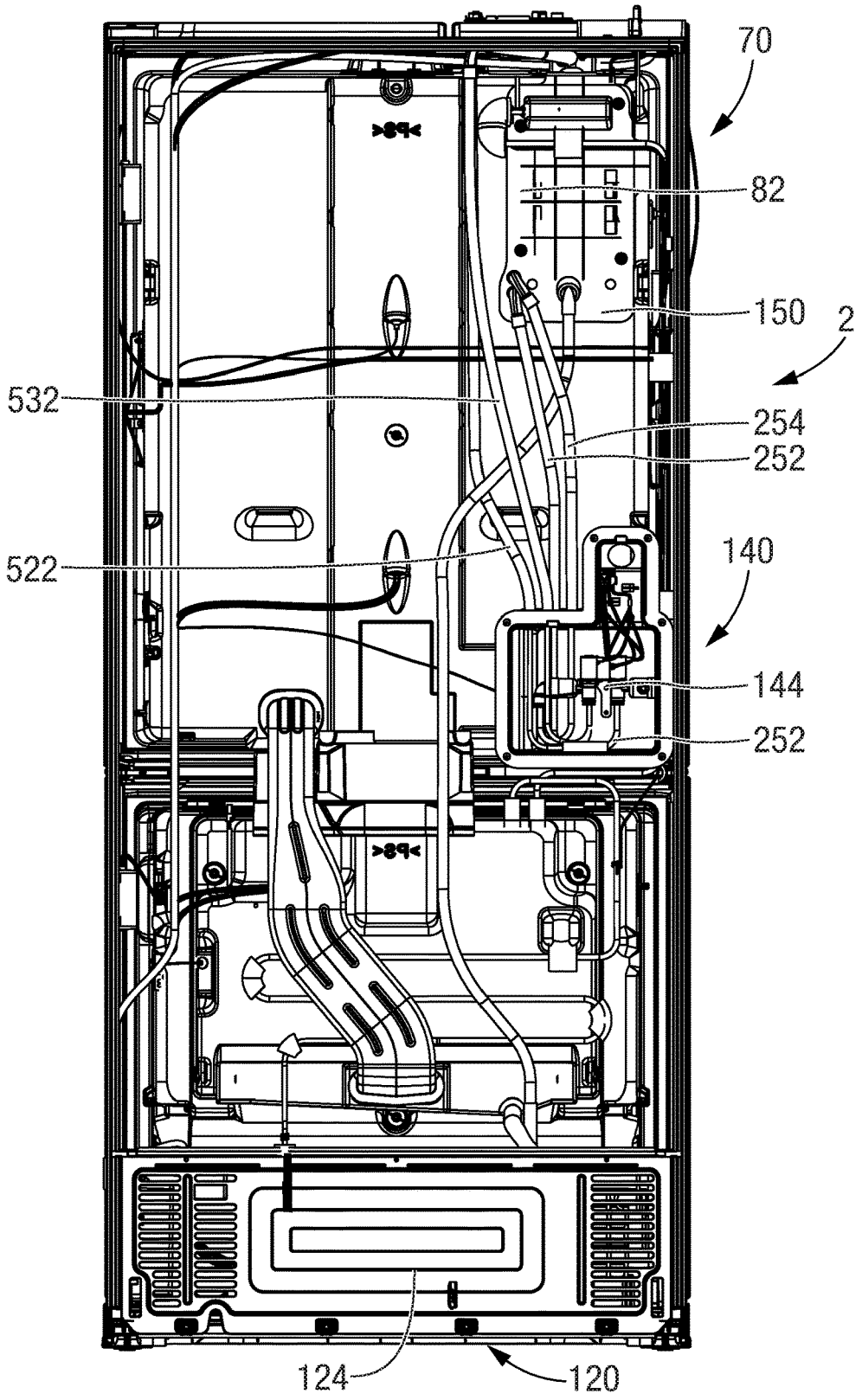
FIG. 16 shows a rear view of the refrigerator.
Figure 17:
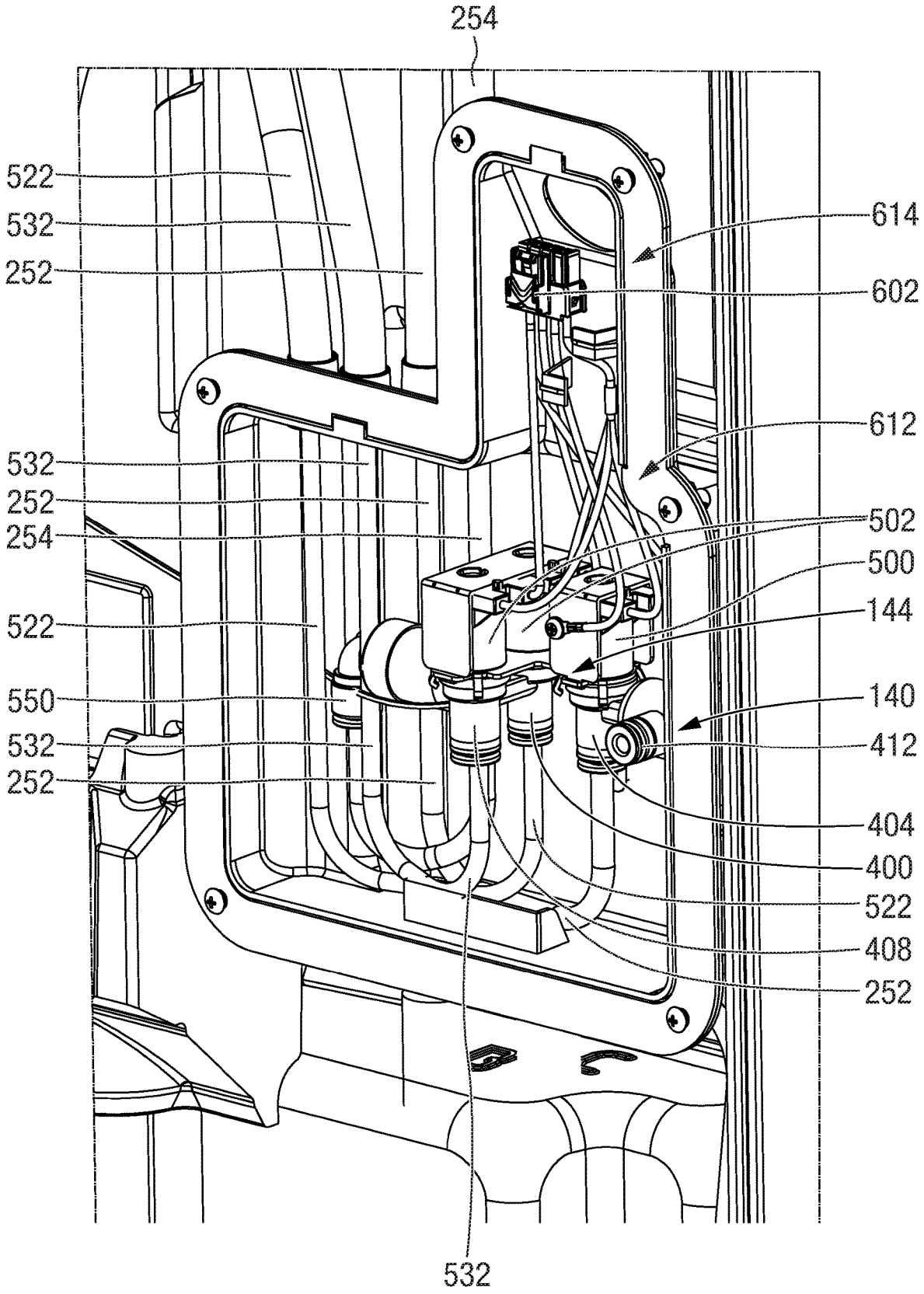
FIG. 17 shows a perspective view of a double valve arranged in a valve housing.
Figure 18:
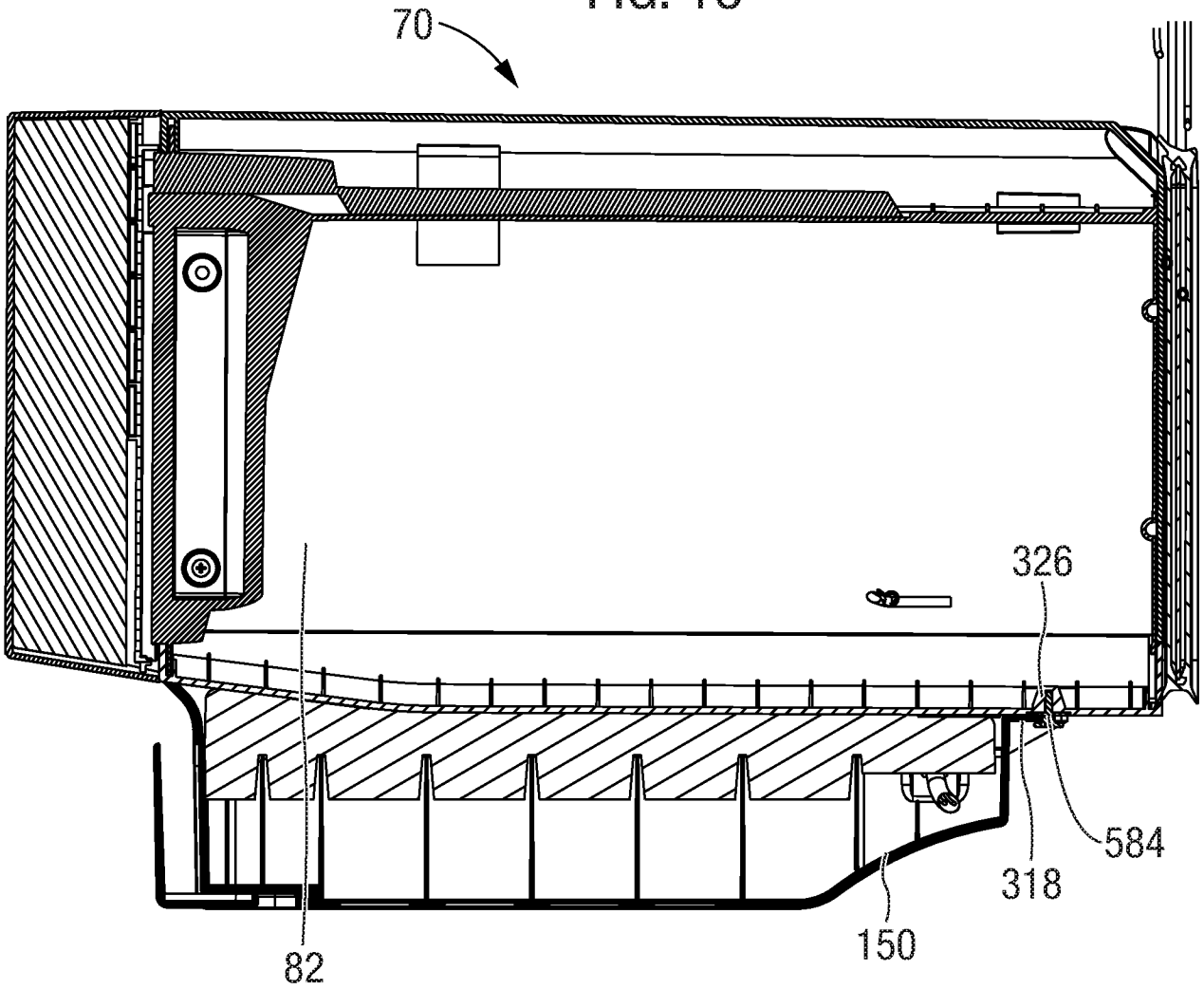
FIG. 18 shows a cross section trough ice maker casing and support housing.

FIG. 16 shows the rear side of refrigerator 2 with the rear wall of cabinet 8 removed. The valve chamber 140 with valve diverter 144 is arranged in the real wall of cabinet 8. The valve diverter 144 is configured to be fluidly connected to water mains. The valve diverter 144 therefore comprises an inlet 412 configured for connection with the water mains/fresh water supply. It is designed to allow a water flow on demand into a water dispenser of refrigerator 2 or into the ice maker assembly 70. Valve diverter 144 comprises a one-way-valve 500 and a two-way-valve 502. The one-way-valve 500 in an open state allows the flow of (pressurized) water from the water mains via an outlet 404 connected to the pipe 252 to an inlet of the water filter 90. After the water is filtered and directed to the water tank 86, it is lead through the 254 pipe to the two-way-valve 502.

With the help of the two-way-valve 502, the thus filtered water can be directed on demand to either the ice maker 76 or to the water dispenser.

An inlet 550 of two-way-valve 502 through the pipe 254 receives filtered water from water tank 86. An outlet 400 of two-way-valve 502 is connected via pipe 522 to the ice-maker 76. An outlet 408 of two-way-valve 502 is connected via pipe 532 to the water dispenser, which is arranged in a front region of the refrigerator 2.

Depending on the state of two-way-valve 502, the filtered water is supplied to the water dispenser or to the to the ice maker 76.

In the valve diverter chamber 140, all electronic parts, especially a control element 602 for switching the valve states and electric wiring 612, are arranged essentially in a dedicated region 614 of valve diverter chamber 140 which in the mounted position is arranged at a higher elevation than the two valves 500, 502. In this way, if a leakage of one or both valves 500, 502 or connections to these valves 60, 502 occurs, dripping water will not get in contact with the electric components, thereby preventing a short-circuit and/or damage to the components.

The pipes leading from the valve diverter 144 to the ice maker assembly 70 are essentially arranged within the foaming and are therefore well protected and insulated. The fact that the valve diverter chamber 140 is arranged in a back wall of cabinet 8 allows easy access to the valve diverter 144 if maintenance is needed.

The invention thus conceived can be subjected to numerous modifications and variants all falling within the scope of the inventive concept. In addition, all details can be replaced by other technically equivalent elements. In practice, all the materials used, as well as the shapes and contingent dimensions, may vary depending on the requirements without departing from the scope of protection of the following claims.

The invention claimed is:

1. A refrigerator comprising:

a cabinet;

a compartment for storing goods formed inside said cabinet and having an open front portion;

a compartment door movably connected to said cabinet for closing at least partially said open front portion of said compartment;

an ice maker assembly arranged inside said compartment, said ice maker assembly comprising an ice maker to generate ice, said ice maker comprising an ice maker casing, a water tank to store the water to be dispensed to said ice maker and a water filter to filter the water to be dispensed to said water tank, said ice maker assembly being accessible inside said compartment when said compartment door is in an open position, wherein said ice maker assembly comprises a support housing arranged below said ice maker casing to receive said water tank and said water filter such that said ice maker casing and said support housing are provided as respective modules, the support housing including a base wall having opposite first and second faces, the water tank being receivable within a water tank chamber defined by the first face of the base wall, and the water filter being receivable within a water filter chamber defined by the second face of the base wall.

2. The refrigerator according to claim 1, wherein said ice maker casing supports said support housing.

3. The refrigerator according to claim 2, whereby said ice maker casing comprises fixing means configured for fixing said support housing to said ice maker casing.

4. The refrigerator according to claim 3, whereby said support housing comprises engagement elements configured to engage with said fixing means of said ice maker casing.

5. The refrigerator according to claim 1, wherein said support housing is at least partly fixed to said ice maker casing.

6. The refrigerator according to claim 5, wherein said support housing is fixed to a bottom side of said ice maker casing.

7. The refrigerator according to claim 1, wherein said ice maker casing comprises a bottom region defining said support housing.

8. The refrigerator according to claim 1, wherein a bottom wall of said ice maker casing is in contact with an upper wall of said support housing.

9. The refrigerator according to claim 1, whereby said support housing comprises a heat-insulating element arranged between said icemaker casing and said water tank.

10. The refrigerator according to claim 1, wherein a water tank cover is provided for covering said water tank chamber.

11. The refrigerator according to claim 10, wherein said water tank cover is built of a heat-insulating material.

12. The refrigerator according to claim 1, whereby said support housing comprises an electric heater for preventing water from icing.

13. The refrigerator according to claim 1, whereby a water filter cover is provided for covering said water filter chamber.

14. The refrigerator according to claim 13, whereby said water filter cover is attachable to said support housing by a snap connection.

15. The refrigerator according to claim 1, whereby in a mounted position said water filter chamber is accessible from the bottom side of said support housing.

16. The refrigerator according to claim 1, wherein a valve housing is arranged in a back side of said cabinet which is designed to receive at least one valve for at least partially directing water from a water supply to said ice maker assembly.

17. The refrigerator according to claim 16, wherein said valve housing is accessible from a backside of said cabinet and is covered by a valve housing cover.

18. The refrigerator according to claim 1, wherein the water tank and the water filter are disposed laterally adjacent to one another, and wherein a partition section of the base wall extends in a vertical direction and is oriented laterally between the water tank and the water filter.

19. The refrigerator according to claim 1, wherein a first heat-insulating element is disposed within the water tank chamber and covers the water tank, and wherein a second heat-insulating element is arranged between the ice maker casing and the water filter.

* * * * *